US008286642B2

(12) United States Patent
Woodson et al.

(10) Patent No.: US 8,286,642 B2
(45) Date of Patent: Oct. 16, 2012

(54) TEMPERATURE SENSITIVE POWDER FOR ENHANCED FLAVOR DELIVERY IN SMOKING ARTICLES

(75) Inventors: Beverley C. Woodson, Ruther Glen, VA (US); Deborah J. Newman, Prince George, VA (US)

(73) Assignee: Philip Morris USA Inc., Richmond, VA (US)

( * ) Notice: Subject to any disclaimer, the term of this patent is extended or adjusted under 35 U.S.C. 154(b) by 162 days.

(21) Appl. No.: 12/559,331

(22) Filed: Sep. 14, 2009

(65) Prior Publication Data

US 2010/0000552 A1 Jan. 7, 2010

Related U.S. Application Data

(62) Division of application No. 10/979,104, filed on Nov. 2, 2004, now abandoned.

(51) Int. Cl.
*A24B 3/14* (2006.01)

(52) U.S. Cl. ..... 131/372; 131/370; 131/374; 131/274; 131/335; 131/337

(58) Field of Classification Search ..... None
See application file for complete search history.

(56) References Cited

U.S. PATENT DOCUMENTS

| | | | | |
|---|---|---|---|---|
| 2,800,457 | A | | 7/1957 | Green et al. |
| 3,006,347 | A | | 10/1961 | Keaton |
| 3,236,244 | A | | 2/1966 | Irby, Jr. et al. |
| 3,339,557 | A | | 9/1967 | Karalus |
| 3,344,796 | A | | 10/1967 | Yamaji et al. |
| 3,426,011 | A | | 2/1969 | Paramerter et al. |
| 3,540,456 | A | * | 11/1970 | McGlumphy et al. ..... 131/337 |
| 3,570,557 | A | | 3/1971 | Molins |
| 3,894,545 | A | * | 7/1975 | Crellin et al. ..... 131/342 |
| 3,972,335 | A | | 8/1976 | Tiggelbeck et al. |
| 4,201,234 | A | | 5/1980 | Neukomm |
| 4,715,390 | A | | 12/1987 | Nichols et al. |
| 4,727,888 | A | | 3/1988 | Luke |
| 4,991,605 | A | | 2/1991 | Keritsis |

(Continued)

FOREIGN PATENT DOCUMENTS

GB 1585761 3/1981

(Continued)

OTHER PUBLICATIONS

Mr. Schuring, "Micro-encapsulation food ingredients", BILB-Projects; Micro-encapsulation of food ingredients; http:www.ttz-bremerhaven.de/englishch/bilb/microverkapselung.htm; printed Oct. 24, 2002.

(Continued)

*Primary Examiner* — Michael J Felton
(74) *Attorney, Agent, or Firm* — Buchanan Ingersoll & Rooney PC

(57) ABSTRACT

Improved delivery of additive materials to mainstream smoke produced by smoking articles is provided through the use of a temperature sensitive powder containing an additive material, such as a flavor component, in a smoking article such as a cigarette. The temperature sensitive powder is subjected to heat which causes the temperature sensitive powder to release at least a portion of the additive material into mainstream smoke. The temperature sensitive powder encapsulates the additive materials and other portions of the smoking articles, such as sorbents or filter materials, in order to reduce additive material migration during storage.

11 Claims, 4 Drawing Sheets

U.S. PATENT DOCUMENTS

| | | | | | |
|---|---|---|---|---|---|
| 5,065,775 | A | * | 11/1991 | Fagg | 356/432 |
| 5,124,162 | A | | 6/1992 | Boskovic et al. | |
| 5,137,034 | A | | 8/1992 | Perfetti et al. | |
| 5,144,964 | A | | 9/1992 | Demain | |
| 5,322,075 | A | | 6/1994 | Deevi et al. | |
| 5,388,594 | A | | 2/1995 | Counts et al. | |
| 5,499,636 | A | | 3/1996 | Baggett, Jr. et al. | |
| 5,505,214 | A | | 4/1996 | Collins et al. | |
| 5,591,368 | A | | 1/1997 | Fleischhauer et al. | |
| 5,666,976 | A | | 9/1997 | Adams et al. | |
| 5,692,525 | A | | 12/1997 | Counts et al. | |
| 5,692,526 | A | | 12/1997 | Adams et al. | |
| 5,810,020 | A | * | 9/1998 | Northway et al. | 131/297 |
| 5,915,387 | A | | 6/1999 | Baggett, Jr. et al. | |
| 5,934,289 | A | | 8/1999 | Watkins et al. | |
| 5,988,176 | A | | 11/1999 | Baggett, Jr. et al. | |
| 6,026,820 | A | | 2/2000 | Baggett, Jr. et al. | |
| 6,053,176 | A | | 4/2000 | Adams et al. | |
| 6,209,547 | B1 | | 4/2001 | Koller et al. | |
| 6,325,859 | B1 | | 12/2001 | De Roos et al. | |
| 6,482,433 | B1 | * | 11/2002 | DeRoos et al. | 424/464 |
| 6,595,218 | B1 | | 7/2003 | Koller et al. | |
| 2003/0026872 | A1 | | 2/2003 | Dake et al. | |
| 2004/0129280 | A1 | | 7/2004 | Woodson et al. | |
| 2005/0000531 | A1 | | 1/2005 | Shi | |

FOREIGN PATENT DOCUMENTS

| | | |
|---|---|---|
| GB | 2249936 | 5/1992 |
| WO | WO 01/80671 | 11/2001 |
| WO | WO 01/80973 | 11/2001 |

OTHER PUBLICATIONS

International Search Report and Written Opinion dated Mar. 3, 2006 for PCT/IB2005/003402.

* cited by examiner

TEMPERATURE SENSITIVE POWDER FOR ENHANCED FLAVOR DELIVERY IN SMOKING ARTICLES

CROSS-REFERENCE TO RELATED APPLICATIONS

This application is a divisional application of U.S. application Ser. No. 10/979,104 entitled TEMPERATURE SENSITIVE POWDER FOR ENHANCED FLAVOR DELIVERY IN SMOKING ARTICLES, filed on Nov. 2, 2004 now abandoned, the entire content of which is hereby incorporated by reference.

BACKGROUND

In smoking articles such as cigarettes, various proposals have been made to deliver liquid such as water, flavorant or other substances such as fragrances to tobacco smoke.

SUMMARY

In a first embodiment, a cigarette comprises a tobacco rod including a powder containing an additive material for modifying characteristics of tobacco smoke during smoking of the cigarette, wherein the powder is temperature sensitive and releases at least a portion of the additive material when the powder is heated. The cigarette can also include a film applied to a filler or mat containing a temperature sensitive powder, wherein the film can be used to further limit migration of the additive material and wherein the temperature sensitive powder will release the additive material when it is heated or burned.

In another embodiment, a method of making a cigarette comprises incorporating a temperature sensitive powder containing an additive material into a tobacco rod and forming a cigarette with the tobacco rod.

In another embodiment, a method of smoking a smoking article comprises releasing additive properties from an additive material in a temperature sensitive powder in the smoking article.

In another embodiment, a tobacco mat for an electrical smoking system cigarette comprises a temperature sensitive powder containing an additive material and tobacco.

DETAILED DESCRIPTION

Figure 1:
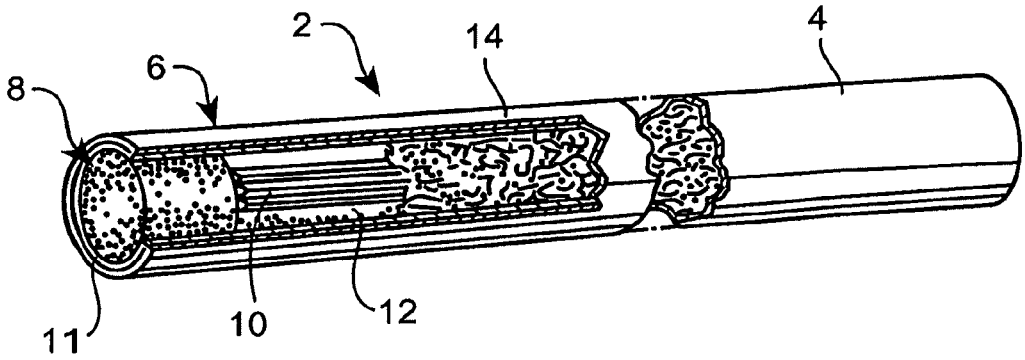
FIG. 1 is a partially exploded perspective view of a cigarette incorporating one embodiment wherein the cigarette includes temperature sensitive powder and folded paper containing sorbent is inserted into a hollow portion of a tubular filter element of the cigarette.

Volatile additives, such as volatile flavorings, are desirably volatilized when a cigarette is smoked. However, volatile flavorings tend to migrate in the cigarette to other components and possibly through the entire cigarette. Volatile flavorings may also be lost during storage and distribution under ordinary conditions prior to smoking of the cigarettes. The degree of migration of volatile flavorings in cigarettes depends on different factors, including, by way of example, the flavoring's vapor pressure, the solubility of the flavoring in other components of the cigarette, and temperature and humidity conditions. In addition, a large portion of the volatile flavorings may be lost to the side stream smoke in traditional cigarettes.

Consequently, the flavorings incorporated in some traditional cigarettes have not satisfactorily provided the desired taste effect to the smoker and the flavorings' desired value to the subjective quality of the cigarette has been less than desired. Thus, there is still a need in the art for improved articles and methods of delivering additive materials such as flavorings to smoking articles.

In order to provide additive properties, such as flavorings, to smoking articles, additive materials may be added to the smoking articles. The additive materials may be added to the tobacco, a tobacco mat, a filter, a paper wrapper or any other part of a smoking article. Preferably, the additive materials can provide flavor, enhanced chemical reaction, etc. in order to alter or enhance the properties of the smoke created in the smoking article.

The additive materials should also be easily accessible to the smoke created when the smoking article is smoked, while having low migration within the smoking article during storage of the smoking article for the reasons discussed above. In order to minimize migration, and also absorption or adsorption of the additive materials, traditional methodology, such as pack foil, filter plasticizers and volatile aftercut on filler have been used. However, the additive materials can still migrate and are not controllably releasable within the smoking article by these traditional methods. Therefore, additive materials in the form of a temperature sensitive powder, such as a multi-stage dried (MSD) powder, are provided herein.

By using additive materials in the form of temperature sensitive powders such as MSD powders, the additive materials can be stored with reduced migration properties and can be controllably released upon an application of a predetermined stimulus mechanism, such as heat. Thus, the additive materials in the temperature sensitive powders such as MSD powder can have decreased levels of evaporation and migration over time within the smoking article because of the properties rendered by the use of temperature sensitive powder. Suitable menthol-containing powders can be obtained from Mane SA located in Le Bar Sur Loup, France.

In a MSD process, additive materials are generally formed by spray drying, fluid bed drying and/or belt drying in multiple steps to form MSD powder. In order to maintain the effectiveness of the additive materials, the drying is completed at low temperature, where the temperature is effective to dry but does not harm the additive materials being dried. For example, if the MSD powder contains a flavorant, then drying temperatures used in making the MSD powder are below the flavorants' volatilization temperature. For example, MSD powder containing flavorants can be dried in multiple stages at temperatures such as 20-50° C., 50-100° C., 100-150° C. or 150-200° C.

Also, if spray drying is utilized, for example, the additive materials can be atomized from a liquid feed into a spray of droplets, wherein the droplets can be placed in contact with a first temperature drying air in a process chamber to remove moisture. Next, the droplets can be further dried in a second temperature drying air to form dry temperature sensitive powder. Preferably, the second temperature is cooler than the first temperature, but is still sufficiently warm enough to provide effective drying properties. For example, an additive material, such as menthol with a volatilization temperature about 250° F., can be sprayed onto a substrate then passed through a tunnel drier at 200° F. to flash off a majority of the liquid, then can be air dried at room temperature to form a final temperature sensitive powder.

The temperature sensitive powder can be used in any portion of a smoking article. Exemplary portions of the smoking article where the temperature sensitive powder can be used include but are not limited to: within a tobacco filler or reconstituted tobacco filler material, in slurry applied to reconstituted tobacco material during processing or drying, a tobacco containing mat, cigarette filter material, or on/in cigarette wrapper paper.

As indicated herein, the temperature sensitive powder can be provided in various manners in any portion of a smoking article, such as in a tobacco filter or cigarette rod. See, for example, the cigarette filter 6 and/or cigarette rod 4 of FIGS. 1 to 7 where the temperature sensitive powder may be situated in its various forms including when provided in a tobacco mat as described herein.

As the powder is temperature sensitive, the powder contains and reduces migration of the additive material until a temperature change occurs, such as when heat is applied. For example, a flavorant additive material in a temperature sensitive powder in a cigarette can be used for encapsulating and/or isolating the flavorant from other parts of the cigarette, such as a sorbent, until a sufficient amount of heat is applied to release the flavorant from the temperature sensitive powder.

Consequently, the temperature sensitive powder can be used effectively in smoking articles, which include sorbents, where the additive materials would otherwise be sorbed by the sorbents. The use of temperature sensitive powder allows additive materials to be released upon smoking of a cigarette while not being released during storage, and also allows for the additive materials to modify smoke properties from the cigarette.

A. Cigarettes

The smoking articles envisioned herein include cigarettes, such as traditional and non-traditional cigarettes, cigars and other smoking devices. Non-traditional cigarettes include, for example, cigarettes for electrical smoking systems as described in commonly-assigned U.S. Pat. Nos. 6,026,820; 5,988,176; 5,915,387; 5,692,526; 5,692,525; 5,666,976; and 5,499,636, the disclosures of which are incorporated by reference herein in their entireties. For purposes of illustration, cigarettes which may be traditional or non-traditional will be primarily discussed even though the temperature sensitive powders may be used with any smoking article.

A cigarette 2 typically contains two sections, as illustrated in FIG. 1, a tobacco-containing portion sometimes referred to as the tobacco or cigarette rod 4, and a filter portion 6, which may be referred to as a filter tipping. Tipping paper 14 typically surrounds the filter, which is placed in the mouth. The tipping paper overlaps with the tobacco rod in order to hold the filter and tobacco rod together.

The tobacco rod 4, or tobacco containing element of the cigarette, includes a cigarette wrapping paper in which the tobacco is wrapped and an adhesive holding the seams of the paper together. The tobacco rod has a mouthpiece filter plug 8 which is integrally attached to the filter 4.

When the tobacco rod is lit or heated for smoking, the smoke travels from the lit or heated end downstream to the filter end of the tobacco rod, and further downstream through the filter to the mouth of the smoker.

An exemplary embodiment of a method of making smoking articles comprises forming a tobacco portion by providing a cut filler (and a tobacco web, if desired) to a cigarette-making machine; placing a paper wrapper around the tobacco portion to form a tobacco rod; and attaching a filter portion to the tobacco rod to form the smoking article, wherein temperature sensitive powder can be incorporated into the tobacco portion, the paper wrapper and/or the filter portion.

The term "mainstream smoke" includes the mixture of gases and/or aerosols passing down a smoking article, such as a tobacco rod, and issuing from an end, such as through the filter end, i.e., the amount of smoke issuing or drawn from the mouth end of a cigarette during smoking of the cigarette. The mainstream smoke contains air that is drawn in through the heated region of the cigarette and through the paper wrapper.

"Smoking" of a cigarette (or smoking article) means the heating, combusting or otherwise causing a release of certain chemicals from tobacco. Generally, smoking of a cigarette involves lighting one end of the cigarette and drawing the smoke downstream through the mouth end of the cigarette, while the tobacco contained therein undergoes a combustion reaction. However, the cigarette may also be smoked by other means. For example, the cigarette may be smoked by heating the cigarette using an electrical heater, as described, for example, in commonly-assigned U.S. Pat. No. 6,053,176; 5,934,289; 5,591,368 or 5,322,075, each of which is incorporated herein by reference in its entirety.

B. Tobacco

Examples of suitable types of tobacco materials that may be used include, but are not limited to, flue-cured tobacco, Burley tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. Tobacco substitutes may also be used.

In cigarette manufacture, the tobacco is normally used in the form of cut filler, i.e., in the form of shreds or strands cut into widths ranging from about 1/10 inch to about 1/20 inch or even about 1/40 inch. The lengths of the strands range from between about 0.25 inch to about 3.0 inches. The cigarettes may further comprise one or more flavors, as described above, or other additives (e.g., burn additives, combustion modifying agents, coloring agents, binders, etc.).

C. Filters

The filter material of the filter may be any of the variety of fibrous materials known for use in tobacco smoke filter elements. Typical materials include cellulose acetate, polypropylene or paper. Preferably, the filter material will be cellulose acetate.

Various cigarette filter constructions may be used, where exemplary filter structures that may be used include, but are not limited to, a mono filter, a dual filter, a triple filter, a single or multi-cavity filter, a recessed filter, a free-flow filter, combinations thereof and the like.

Mono filters typically contain cellulose acetate tow or cellulose paper materials. Pure mono cellulose filters or paper filters offer good tar and nicotine retention, and are highly degradable. Dual filters typically comprise a cellulose acetate mouth end and a pure cellulose or cellulose acetate segment. The length and pressure drop of the segments in a dual filter may be adjusted to provide optimal sorption, while maintaining acceptable draw resistance. Triple filters may include mouth and smoking material or tobacco side segments, and a middle segment comprising paper. Cavity filters include two segments, e.g., acetate-acetate, acetate-paper or paper-paper, separated by at least one cavity. Recessed filters include an open cavity on the mouth side. The filters may also be ventilated and/or comprise additional sorbents (such as charcoal or magnesium), catalysts and/or other additives suitable for use in the cigarette filter.

The filter may comprise a sorbent in the form of oriented fibers and a sleeve, such as paper, surrounding the fibers. The sorbent can be, for example, one or more of activated carbon, zeolite, and other molecular sieves in fibrous forms. Sorbent mixtures can provide different filtration characteristics to achieve targeted filtration of mainstream smoke.

Filter segments including fibers can be formed, for example, by stretching a bundle of non-crimped sorbent fiber material, preferably having a controlled total and per filament denier, through a pre-formed or in-situ formed sleeve during the filter making process. The formed filter can be sized by cutting to a desired length. For example, the filter segments can have a length of from about 5 mm to about 30 mm.

The filter segment can be in contact with (i.e., abut) a free-flow filter positioned between the filter segment and a mouthpiece filter plug or in contact with (i.e., abut) a mouthpiece filter plug. The filter preferably has a diameter substantially equal to that of the outer diameter of a free-flow filter to minimize by-pass of smoke during the filtration process.

The fibrous sorbents preferably have a high loft with a suitable packing density and fiber length such that axially extending pathways are created between fibers. Such structure can effectively remove significant amounts of selected gas-phase constituents, such as formaldehyde and/or acrolein, while preferably removing only a minimal amount of particulate matter from the smoke, thereby achieving a significant reduction of the selected gas-phase constituents, while not significantly affecting the total particulate matter (TPM) in the tobacco smoke. A sufficiently low packing density and a sufficiently short fiber length are preferred to achieve such filtration performance.

D. Sorbents

As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that may condense or hold molecules of other substances on its surface, and/or take up other substances, i.e., through penetration of the other substances into its inner structure, or into its pores. Therefore, as used herein, the term "sorbent" refers to an adsorbent, an absorbent, a catalyst or a substance that may perform any combination of these functions.

As used herein, the term "remove" refers to adsorption and/or absorption of at least some portion of a constituent of mainstream tobacco smoke.

While any suitable material may be used as a sorbent, preferred embodiments include carbons such as activated carbon, alumina, silicates, molecular sieves, zeolites, metal particles and mixtures thereof. The sorbent material may be any material which has the ability to absorb, adsorb and/or catalyze gas components on the surface thereof or to assimilate such components into the body thereof. In a preferred embodiment, the sorbent material is activated carbon.

Activated forms of carbon have strong physical adsorption forces, and high volumes of adsorbing porosity. The activated carbon could be manufactured by any suitable technique. One technique is the carbonization of coconut husk, coal, wood, pitch, cellulose fibers, or polymer fibers, for example. Carbonization is preferably carried out at high temperatures, i.e., 200-800° C. in an inert atmosphere, followed by activation under reducing conditions. The activated carbon used in the smoking articles could be in the form of monolithic shapes, granules, beads, powders or fibers.

Activated carbon may include a distribution of micropores, mesopores and macropores. The term "microporous" generally refers to such materials having pore sizes of about 20 Å or less while the term "mesoporous" generally refers to such materials with pore sizes of about 20 to 500 Å. The term "macroporous" refers to pore sizes above 500 Å. The relative amounts of micropores, mesopores and macropores can be preselected relative to the selected components from mainstream tobacco smoke that are to be targeted and removed. Thus, the pore sizes and pore distribution can be adjusted accordingly as needed for a certain application.

The term "microporous molecular sieves" generally refers to molecular sieve materials having pore sizes of about 20 Å or less. The term "mesoporous molecular sieves" generally refers to such materials with pore sizes of about 20 to 500 Å. Materials with pore sizes of about 500 Å or larger may be referred to as "macroporous molecular sieves." In embodiments, one or more different types of molecular sieves may be used in combination.

The term "molecular sieve" as used herein refers to a porous structure composed of an inorganic silicate material. Zeolites have channels or pores of uniform, molecular sized dimensions. There are many known unique zeolite structures having different sized and shaped channels or pores. The size and shape of the channels or pores can significantly affect the properties of these materials with regard to adsorption and separation characteristics. Zeolites can be used to separate molecules in the channels or pores, and/or by differences in strength of sorption. By using one or more zeolites having channels or pores larger than selected components of mainstream smoke, only selected molecules that are small enough to pass through the pores of the molecular sieve material are able to enter the cavities and become sorbed by the zeolite.

Microporous, mesoporous and/or macroporous molecular sieves may be used. They are selected for use in a filter system based on the particular component(s) to be removed from the mainstream smoke. Molecular sieves which are useful in the smoking articles include crystalline aluminosilicates, silicoaluminophosphates (AlPO/SAPO) and mesoporous molecular sieves such as MCM-41, MCM-48 and SBA-15. This family of mesoporous materials contains regular arrays of uniformly-sized channels and tunable internal active sites which admit molecules below a certain size into their internal space making them useful as catalysts and absorbents.

While sorbents are useful for filtering cigarette smoke, sorbents may also hinder a cigarette designer's ability to use additives, such as volatile flavor components like menthol, for example. In particular, microporous sorbents, such as activated carbon, tend to adsorb and/or absorb additive materials, such as flavor components, during the time between cigarette manufacture and use by the consumer, thus reducing the effectiveness of the additive materials in the cigarette.

In addition to the reduction of the effectiveness of the additive materials due to the adsorption/absorption by the sorbents, two additional problems are also encountered when the additive materials migrate to and are adsorbed/absorbed by the sorbent. First, the additive materials may occupy active sites in the sorbent, thereby reducing the sorbent's ability to remove targeted gas phase components from smoke. Second, because the additive materials are often strongly adsorbed/absorbed by the sorbent, the additive materials may not be sufficiently releasable.

Figure 2:
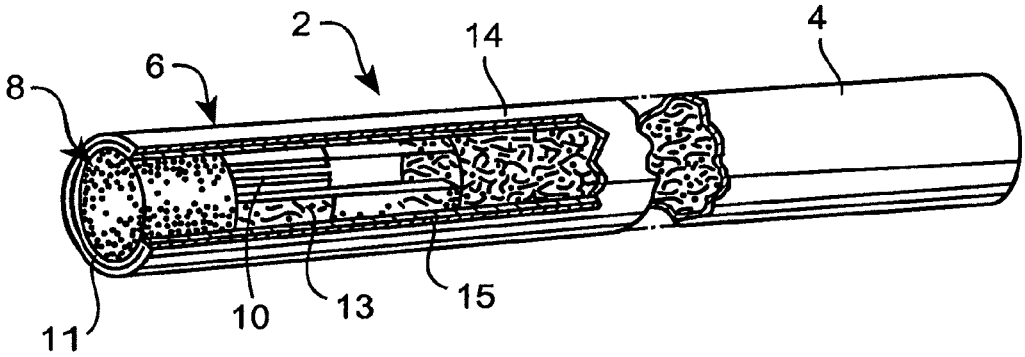
FIG. 2 is partially exploded perspective view of another embodiment wherein the cigarette includes temperature sensitive powder and the sorbent is incorporated in folded paper and inserted into a hollow portion of a first free-flow sleeve of a tubular filter element next to a second free-flow sleeve.

Sorbents can be placed in filters to reduce their interaction with tobacco, such as tobacco in the tobacco rod. For example, as illustrated in FIGS. 1-7, sorbent may be located in a filter of a cigarette. As illustrated in FIG. 1, folder paper 10 incorporating sorbent is located in a hollow cavity, such as the interior of a free-flow sleeve 12, forming part of the filter portion 6 of a cigarette 2. Alternatively, as illustrated in FIG. 2, the folded paper 10 can also be located in a hollow cavity of a first free flow sleeve 13 located between a mouthpiece filter 8 and a second free-flow sleeve 15 of the cigarette 2.

Figure 3:
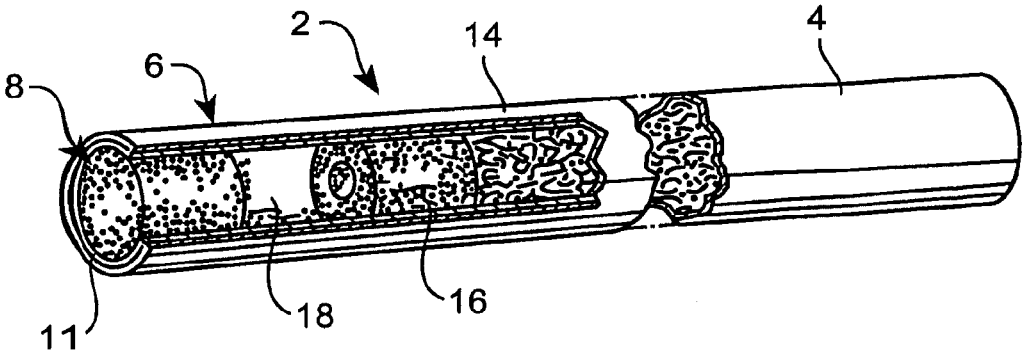
FIG. 3 is a partially exploded perspective view of another embodiment wherein the cigarette includes temperature sensitive powder and the sorbent is incorporated in a plug-space-plug filter element.
Figure 4:
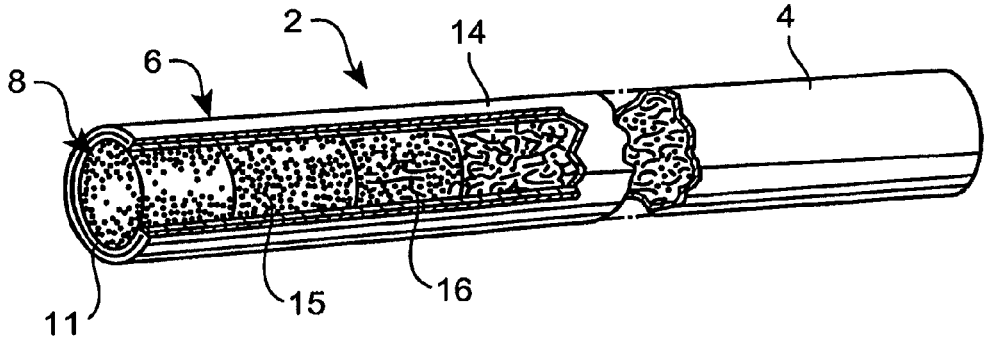
FIG. 4 is a partially exploded perspective view of another embodiment wherein the cigarette includes temperature sensitive powder and the sorbent is incorporated in a three-piece filter element having three plugs.

Also, as illustrated in FIG. 3, a cigarette 2 can include a tobacco rod 4, a filter portion 6, a mouthpiece filter 8, a plug 16, a space 18, and a filter or overwrap 11, wherein sorbent can be incorporated in any element of the filter portion of the cigarette 2. In FIG. 4, the cigarette arrangement of FIG. 3 is used except the space 18 is filled with granules of sorbent or a plug 15 of sorbent can be placed in the space 18.

Figure 5:
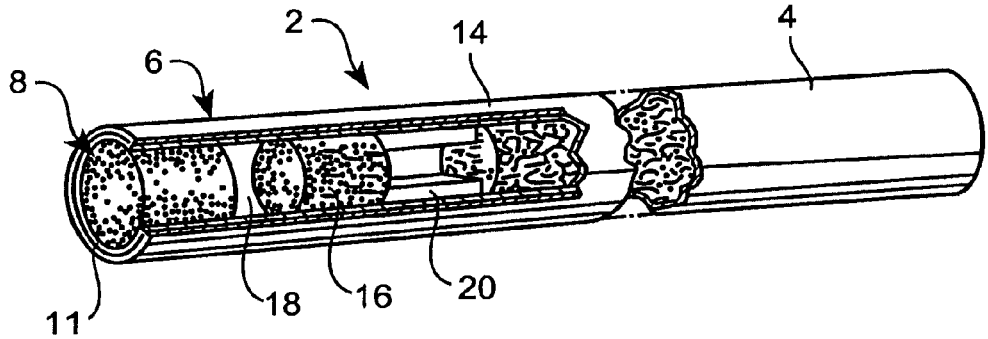
FIG. 5 is a partially exploded perspective view of another embodiment wherein the cigarette includes temperature sensitive powder and the sorbent is incorporated in a four-piece filter element having a plug-space-plug arrangement and a hollow sleeve.

FIG. 5 shows a cigarette 2 comprised of a tobacco rod 4 and a filter portion 6, wherein the filter portion 6 includes a mouthpiece filter 8, a filter overwrap 11, tipping paper 14 to join the tobacco rod 4 and filter portion 6, a space 18, a plug 16, and a hollow sleeve 20. A sorbent can be incorporated into one or more elements of the filter portion 6. For instance, the sorbent can be incorporated into the sleeve 20 or granules of the sorbent can be filled into the space within the sleeve 20. If desired, the plug 16 and sleeve 20 can be made of material such as fibrous polypropylene or cellulose acetate containing sorbent.

Figure 6:
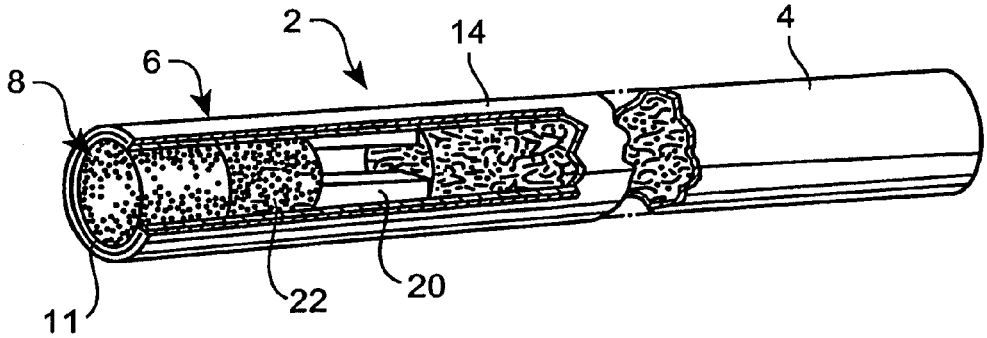
FIG. 6 is a partially exploded perspective view of another embodiment wherein the cigarette includes temperature sensitive powder and the sorbent is incorporated in a three-part filter element having two plugs and a hollow sleeve.
Figure 7:
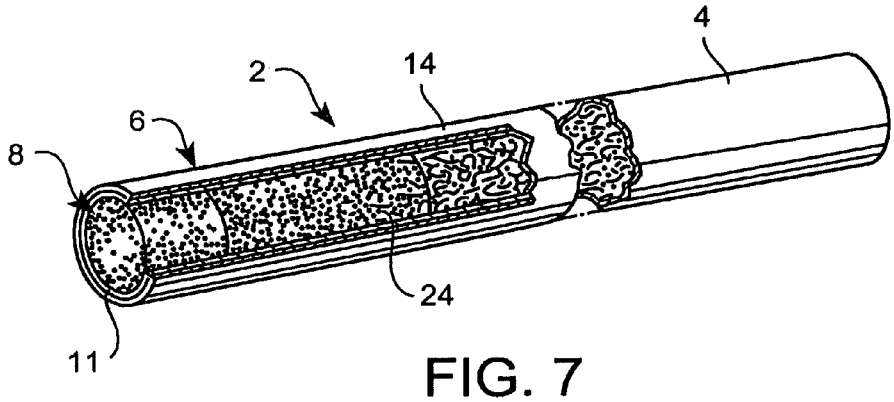
FIG. 7 is a partially exploded perspective view of another embodiment wherein the cigarette includes temperature sensitive powder and the sorbent is incorporated in a two-part filter element having two plugs.

FIGS. 6 and 7 show further modifications of the filter portion 6. In FIG. 6, cigarette 2 is comprised of a tobacco rod 4 and filter portion 6. The filter portion 6 includes a mouthpiece filter 8, a filter overwrap 11, a plug 22, and a sleeve 20, wherein sorbent can be incorporated in one or more of these filter elements. In FIG. 7, the filter portion 6 includes a mouthpiece filter 8 and a plug 24, and the sorbent can be incorporated in one or more of these filter elements. Like the plug 16, the plugs 22 and 24 can be made of material such as fibrous polypropylene or cellulose acetate containing sorbent. In the cigarettes shown in FIGS. 6 and 7, the tobacco rod 4 and filter portion 6 are joined together by tipping paper 14.

Figure 9:
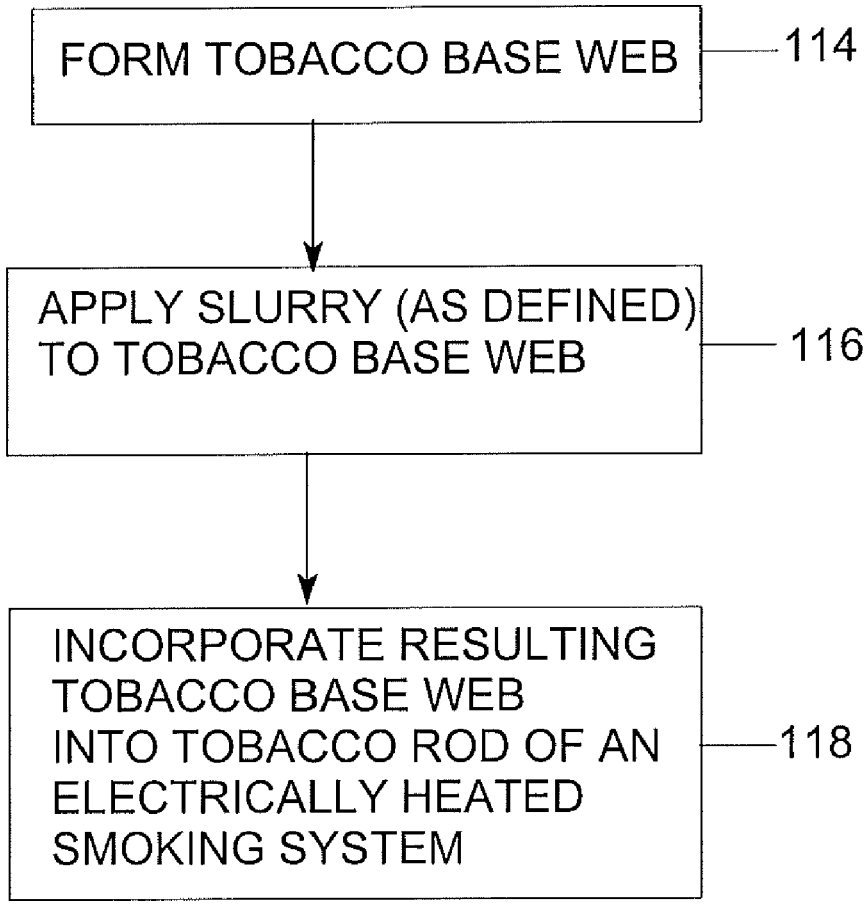
FIG. 9 is a method flow diagram that succinctly presents steps of the claimed invention.

FIG. 9 presents a flow diagram of the claimed method for the formation of an electrically heated smoking system comprising a tobacco rod. In the initial step of the method, a tobacco base web 114 is formed. Thereafter, a slurry (as defined) 116 is applied to the tobacco base web 114 comprising ground tobacco, temperature sensitive powder, and additive material (e.g., flavorant). Thereafter, the resulting tobacco web is incorporated into the tobacco rod 118 of an electrically heated smoking system.

Various techniques can be used to apply the sorbent to filter fibers or other substrate supports. For example, the sorbent can be added to the filter fibers before they are formed into a filter cartridge segment. The sorbent can be added to the filter fibers, for example, in the form of a dry powder or slurry. If the sorbent is applied in the form of a slurry, the fibers are allowed to dry before they are formed into a filter cartridge.

In another preferred embodiment, the sorbent is employed in a hollow portion of a cigarette filter. For example, some cigarette filters have a plug/space/plug configuration in which the plugs comprise a fibrous filter material and the space is simply a void between the two filter plugs. That void can be filled with the sorbent. An example of this embodiment is shown in FIG. 3. The sorbent can be in granular form or can be loaded onto a suitable support such as a fiber or thread.

In another embodiment, the sorbent is employed in a filter portion of a cigarette for use with a smoking device as described in commonly assigned U.S. Pat. No. 5,692,525, the entire content of which is hereby incorporated by reference.

Figure 8:
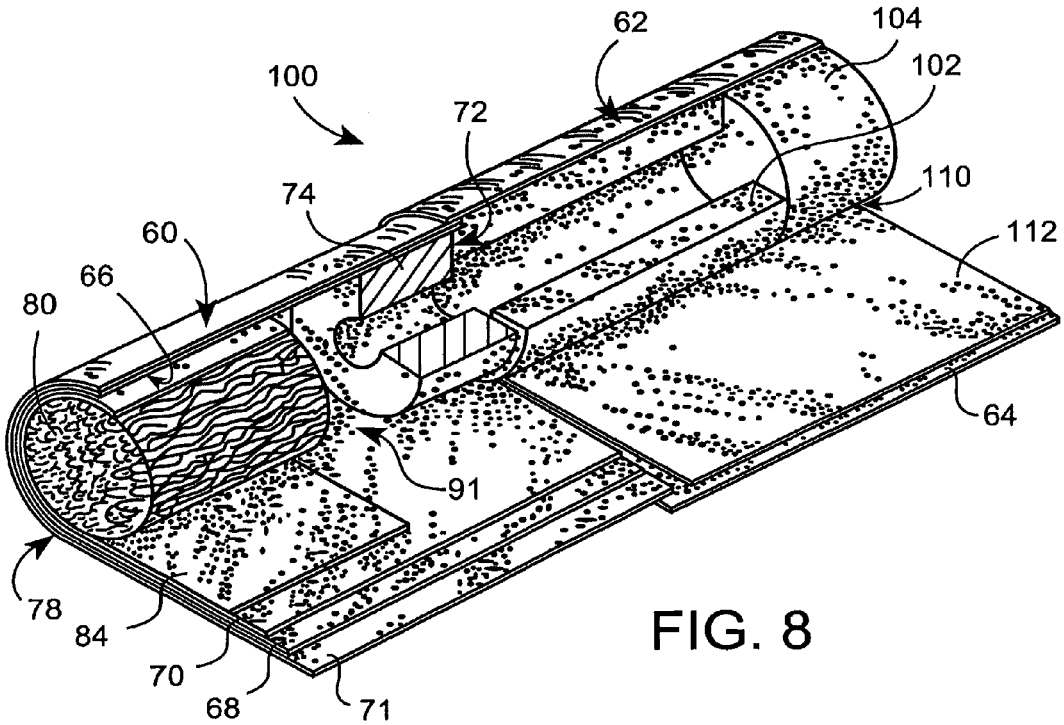
FIG. 8 is a partially exploded perspective view of another embodiment wherein the cigarette includes temperature sensitive powder and the sorbent is incorporated in a filter element which may be used in a smoking article.

FIG. 8 illustrates one type of construction of a cigarette 100 which can be used with an electrical smoking device. As shown, the cigarette 100 includes a tobacco rod 60 and a filter portion 62 joined by tipping paper 64. The filter portion 62 preferably contains a tubular free-flow filter element 102 and a mouthpiece filter plug 104. The free-flow filter element 102 and mouthpiece filter plug 104 may be joined together as a combined plug 110 with plug wrap 112. The tobacco rod 60 can have various forms incorporating one or more of the following items: an overwrap 71, another tubular free-flow filter element 74, a cylindrical tobacco plug 80 preferably wrapped in a plug wrap 84, a tobacco web or matt 66 comprising a base web 68 and tobacco flavor material 70, and a void space 91. The free-flow filter element 74 provides structural definition and support at the tipped end 72 of the tobacco rod 60. At the free end 78 of the tobacco rod 60, the tobacco web 66 together with overwrap 71 is wrapped about cylindrical tobacco plug 80. Various modifications can be made to a filter arrangement for such a cigarette by incorporating a sorbent therein.

In such a cigarette, a sorbent can be incorporated in various ways such as by being loaded onto paper or other substrate material which is fitted into the passageway of the tubular free-flow filter element 102 therein. It may also be deployed as a liner or a plug in the interior of the tubular free-flow filter element 102. Alternatively, the sorbent can be incorporated into the fibrous wall portions of the tubular free-flow filter element 102 itself. For instance, the tubular free-flow filter element or sleeve 102 can be made of suitable materials such as polypropylene or cellulose acetate fibers and the sorbent can be mixed with such fibers prior to or as part of the sleeve forming process.

While a preferred cigarette includes a sorbent, the additive materials may also be used in smoking articles without a sorbent. Regardless of the type of article in which the additive materials is incorporated, the temperature sensitive powders, such as MSD powders, provide effective containment and delivery of additive materials.

E. Additive Materials

The term "additive materials" means any material or component which modifies the characteristics of a smoking article when the smoking article is smoked. Any appropriate additive material or combination of materials may be formed as a temperature sensitive powder, such as MSD powder, to modify the smoke characteristics of the cigarette or other smoking article. Such additive materials include flavors, neutralizing agents, and other modifiers.

In a preferred embodiment, the additive materials may include one or more flavors, such as liquid flavors or flavor-containing materials. The term "flavor" or "tobacco flavor" may include any flavor compound or tobacco extract suitable for being releasably disposed within a temperature sensitive powder, such as MSD powder to enhance the taste of mainstream smoke produced, for example, by a smoking article.

Suitable flavors or flavorings include, but are not limited to, menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, and tobacco flavor. Other suitable flavors may include flavor compounds selected from the group consisting of an acid, an alcohol, an ester, an aldehyde, a ketone, a pyrazine, combinations or blends thereof and the like. Suitable flavor compounds may be selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, combinations thereof and the like.

In one embodiment, the additive material may serve as a sorbent of targeted components in mainstream smoke. Such an additive material may include, by way of example, a chemical additive which chemically reacts with the targeted constituent in mainstream smoke. For example, see commonly assigned U.S. Pat. Nos. 6,209,547 and 6,595,218, which discuss reagents which chemically react with and remove a gaseous component of a smoke stream, and are expressly incorporated herein by reference in their entireties.

F. Temperature Sensitive Powder

Using additive materials, such as flavors, in temperature sensitive powders, such as MSD powders, in a smoking article provides advantages particularly for cigarettes containing sorbents. By using the temperature sensitive powders, such as MSD powders, in cigarettes containing sorbents, sorption of the additive materials in the temperature sensitive powders by the sorbents is substantially prevented and controlled release of the additive materials is provided.

For purposes of discussion the term "MSD powder" will be used to describe the temperature sensitive powder even though any temperature sensitive powder capable of controllably releasing additive materials is contemplated herein. However, it is also noted that MSD powder is a preferred temperature sensitive powder due to its manufacturing ease and consistency.

The term "temperature sensitive" is used herein to refer to a temperature controlled response by a powder. For example, as used herein, a temperature sensitive powder containing additive materials releases the additive materials when a predetermined amount of heat is applied to release additive properties from the temperature sensitive powder.

The terms "releasably disposed" or "controllably released" are used herein to refer to the containment and controlled release of additive materials properties from their MSD powder form. In the MSD powder form, the additive materials are sufficiently contained to substantially avoid or minimize unwanted migration, such as, for example, during storage of the smoking article with the MSD powder (and optional sorbent) therein. This term also includes, but is not limited to, the additive materials in the MSD powder form being mobile enough to be controllably released when, for example, the MSD powder is subjected to heat or combustion.

The MSD powder is a temperature sensitive powder, as mentioned above, where the additive materials can emanate from the MSD powder due to melting or other heat interactions with the powder. The temperature sensitive characteristics of the additive materials and the other constituents of the MSD powder allow for the additive materials to be controllably released with heat. For example, if liquid menthol is incorporated into a MSD powder, where starch in combination with a MSD process is used to form a MSD powder, the temperature at which the menthol liquefies is the critical temperature for releasing (by melting) the menthol from the MSD powder.

The MSD powder can be applied and/or processed for use in a smoking article in a variety of ways. For example, the MSD powder can be compounded into an adhesive and applied during fabrication of a cigarette, applied directly to a tobacco filler or reconstituted tobacco material, applied as an additive to a slurry during processing of a reconstituted material, applied to a reconstituted material during a drying process, applied during processing of cigarette paper or provided in a cavity formed in the cigarette or a cigarette filter, where the MSD powder is preferably provided downstream from a sorbent if a sorbent is provided.

Additionally, as mentioned above, the MSD powder can be used in a non-conventional cigarette, such as an electrical smoking device cigarette. For example, a MSD powder can be incorporated into a tobacco mat, tobacco filler, or cigarette paper to provide encapsulated flavor that has reduced storage migration properties with controlled release properties.

The MSD powder can include any material in addition to the additive materials that will allow and potentially aid the controlled release of the additive material or affect the properties of the additive materials or the MDS powder upon application of heat or burning. For example, the MSD powder can include spray dryable products, preferably food grade spray dryable products, such as starch, sorbitol, maltodextrin or the like, which can provide encapsulation of the additive materials, such as menthol, while not significantly modifying desired characteristics, such as menthol flavor, in the additive materials.

The MSD powder may be formed by any suitable MSD powder forming technique, such as spray drying, fluid bed drying and/or belt drying, where the drying is completed at temperatures below the melting or volatilization levels of the additive materials and/or the MSD powder, in order to produce additive materials in dried powder form. Should too high a temperature be used, the additive material and/or the MSD powder may melt or volatilize during processing and cause agglomeration of the MSD powder or release of the additive materials from the MSD powder form.

MSD powder with additive materials therein are formed by a multi-stage drying process. In an exemplary multi-stage drying process, an additive material is provided in liquid form, and then sprayed through pressure nozzles or a rotary atomizer into heated air at a first temperature to form droplets, where the heated air removes excess liquid to form semi-dried droplets. Next, the semi-dried droplets are fed into a secondary drying area, which is heated at a second temperature different from the first temperature, where the secondary drying area is used to remove excess liquid and dry the semi-dried droplets into MSD powder. In this way, liquid or viscous products, such as liquid menthol (with emulsifiers and spray dryable products) can be converted into dried, heat sensitive powder, where improved retention of the properties of the liquid products can be accomplished.

G. Film

In addition to using MSD powder to encapsulate additive materials, an encapsulating film can also be applied to the MSD powder or other portions of the smoking article to further encapsulate additive materials. Desirably, the film can be used to further reduce migration of the additive materials to other portions of the smoking article during storage of the smoking article.

The film may be made of any film forming agent, preferably a food grade agent. Preferably, the film is also subject to controlled release of the additive materials upon application of a predetermined stimulus, such as heat. For example, one or more of the following may be used: guar gum, xylitol, hydroxypropylcellulose, agar, gum arabic, modified food starch, konjac gum, sodium alginate, sodium alginate PG (propyl gallate), gellan gum, xanthum gum, pectin, whey, carrageenan, zien, carboxymethylcellulose, maltitol, mannitol, hydroxypropylmethylcellulose, polyvinyl alcohol, polyvinyl acetate, or the like.

The film may be applied to a tobacco filler or mat containing MSD powder for use in a smoking article. The film may be applied during or after the processing of the filler or mat, and may also be applied prior to or during fabrication of a smoking article. For example, the film can be sprayed onto a tobacco mat including flavored MSD powder after the tobacco mat is prepared, but before the tobacco mat is placed in a cigarette.

H. Preferred Embodiments

A preferred method of making a MSD powder which provides an encapsulated additive material is provided. A preferred method includes liquefying an additive material and mixing the liquefied additive material with an emulsifier, such as modified food starch, to form an emulsion. The additive material can be a liquid or viscous additive, such as liquid menthol, or can be a solid additive, where the solid additive can be liquefied through the use of solvent, heat, or other liquefying methods.

The emulsion can then be mixed with a powder or other spray dryable media, such as maltodextrin and/or sorbitol, where the powder encapsulates the emulsion of additive and emulsifier. Next, the mixture of emulsion and powder can be sprayed and dried. Preferably, the drying occurs in two stages. First, the sprayed mixture can be sprayed through a heated air drier at a first temperature to remove a majority of the liquid. Second, the sprayed mixture can be dried at a second temperature for removing the remainder of the liquid from the powder. Preferably, the first temperature is hotter than the second temperature to reduce any damage that may be caused by prolonged exposure to the higher temperature while allowing for efficient drying of the final product. By using a plurality of temperature stages, the additive material can be encapsulated and dried to a MSD powder, where the additive material is releasably disposed in the MSD powder.

A tobacco mat is preferably formed by using a paper making-type process to form a base web while concurrently or thereafter applying a tobacco flavor material onto the base web. In the first portion of this process, tobacco strip is washed with water and the solubles are collected for use in a later coating step. The remaining (extracted) tobacco fiber is used in the preparation of a slurry that will be used in web/paper forming techniques to form the base web. To strengthen the base web, carbon fibers may be added to the slurry by dispersing a stock of carbon fibers in water and adding, for example, sodium alginate, to promote dispersion. The carbon fiber dispersion is then added (optionally) to the tobacco-fiber slurry together with (optionally) conventional flavors. Any other hydrocolloid, may be added in lieu of the sodium alginate as long as it preferably does not interfere with the flavored tobacco response, is water soluble and has a suitable molecular weight to impart strength to the tobacco mat. The resultant mixture is then wet-laid onto a Fourdrinier wire of a conventional paper-making machine or the like (such as a steel belt) to form a base web. The solubles previously removed by washing the tobacco strip are mixed with ground tobacco, and the mixture is coated onto one side of the base web, preferably with a standard reverse roll coater located after a drum or Yankee dryer beyond the Fourdrinier wire. The ratio of tobacco solubles to tobacco dust or particulates in the added slurry is preferably set at a value between about 1:1 and 20:1, but preferably at or about 4 to 1. The added slurry may also be cast or extruded onto the base web. Alternatively, the coating step may be executed off-line separate from the production of the base web. During or after the coating step, flavors that are conventional in the cigarette industry are preferably added. Pectin or other hydrocolloids are added, preferably in a range of between 0.1 to 2.0% by weight of the tobacco mat, to improve the coatability of the slurry.

A preferred method of incorporating a flavoring-release additive such as MSD powder into a tobacco mat is provided, where the tobacco mat includes a flavoring-release additive such as MSD powder in a layer on the tobacco mat for controlled release when a cigarette incorporating the tobacco mat is smoked. A preferred method includes forming a tobacco mat by forming a base web, then applying a slurry of a flavoring-release additive such as MSD powder and a liquid, preferably water, onto the base web, where the base web includes ground tobacco. The slurry can be spread across the tobacco mat. Finally, the slurry can be dried through exposure to ambient air, or can be dried by applying heat to the slurry, where the temperature of the heat applied is effective to not melt or volatilize the additive material in the flavoring-release additive.

Preferably, the slurry of a flavoring-release additive such as MSD powder and liquid is prepared just prior to application onto the base web, so as to minimize the amount of time that the flavoring-release additive is contained in the slurry, in order to avoid volatilization of the additive material. More generically, the heat-activated flavoring-release additive preferably has a low solubility in water so as to be compatible with the process of tobacco mat-making or the process of incorporating the flavoring-release additive in a tobacco mat. The temperature of the slurry is preferably maintained at a suitable temperature such as 80 to 100° F. or about 90° F. in order to prevent crystallization of the additive material, such as menthol, at lower temperatures and volatilization of the additive material at higher temperatures.

Additionally, glycerine, pectin, and tobacco dust can also be used in the wet slurry for structural and aesthetic purposes, where the slurry can be spread with a doctor's knife (blade) to provide a relatively uniform thickness for the tobacco mat.

A preferred method of making an encapsulating film on a tobacco mat containing MSD powder is also provided, where the film allows further reduction in migration of additive materials in the MSD powder into a smoking article. By providing the film, the MSD powder can be further isolated from other portions of a smoking article or other smoking articles when packaged together thus reducing any interaction between the additive material and the other portions of the smoking article. The preferred method includes forming a tobacco mat, then spraying a film onto the mat with a spray nozzle where the temperature of the film in the spray nozzle is between 120° F. and 160° F., more preferably about 140° F., during spraying. Next, the film can be put in a drier to expedite and complete drying, where the temperature in the drier does not cause the film or the MSD powder to melt, burn or be otherwise adversely affected.

A preferred embodiment of making a cigarette with MSD powder is provided, where the MSD powder allows for controlled release of additive materials to the cigarette when the cigarette is smoked. A preferred method includes grinding tobacco and removing the tobacco liquid, also known as the concentrated extract liquor (CEL). Next, the remaining tobacco solids can be mixed with cellulose or the like to form a base web. Then, slurry including the MSD powder, CEL, glycerine and/or pectin can be formed on the base web to form a MSD powder layer on the base web.

Next, an optional layer of a tobacco dust can be applied and spread across the base web on the slurry to provide further aesthetic enhancements, such as additional tobacco flavoring, where the base web and slurry can then be dried. Finally, a film, preferably of carrageenan or another relatively flavorless, heat responsive, food grade film can be formed on the dried base web with the dried slurry layer to seal the slurry constituents including the MSD powder, CEL, glycerine and/or pectin under the film and thus prevent migration of any portion of the base web or slurry including the MSD powder.

A preferred embodiment of making a tobacco mat including MSD powder for a cigarette is provided, where the MSD powder allows flavor components of tobacco smoke to be releasably disposed in the tobacco mat. A preferred method includes forming a tobacco mat with MSD powder incorporated therein by mixing the MSD powder with tobacco, then forming a tobacco mat from the mixture. Preferably, the tobacco is ground or reconstituted tobacco such that the tobacco and the MSD powder are miscible prior to forming the tobacco mat from the tobacco and the MSD powder.

Preferably, the tobacco mat is formed such that the width of the formed tobacco mat is greater than a width of the tobacco mat used in a cigarette. For example, a tobacco mat can be formed about 12 to 18 inches wide.

Additionally, a film can optionally be sprayed onto the tobacco mat using a spray nozzle, where the film is preferably heated to liquefy the film material. For example, if carrageenan is used for the film, the carrageenan can be heated to between about 120° F. and 160° F., more preferably about 140° F. to provide a desirable spraying viscosity. Next, the film can be dried in ambient air, or a dryer or a vacuum may be used to enhance the drying process.

After the tobacco mat is formed (and the film formed if desired), the tobacco mat can be slit or cut into sizes for use in a smoking article. For example, if the tobacco mat is to be used in a standard sized non-traditional cigarette, such as cigarettes used in electrically heated cigarette smoking systems, tobacco mat widths of about 23.2 mm would be desired.

Another method of forming a film on a tobacco mat including MSD powder for a cigarette is provided, where the drying process for the film is part of a tobacco mat rolling process. A preferred method includes forming a first bobbin of tobacco mat including the MSD powder prior to the forming of a film thereon. The tobacco mat from the first bobbin can then be unwound from the first bobbin to a second bobbin and wound onto the second bobbin for later incorporation in a cigarette. Between the first and second bobbins as the tobacco mat travels from the first bobbin to the second bobbin, a film can be applied to the tobacco mat. Preferably, the first bobbin is located a distance away from the second bobbin, where the distance allows for the film to dry prior to being rolled into the second bobbin.

Preferably, the film is applied in several lines onto the tobacco mat, where surface tension spreads the film across the surface of the tobacco mat. Optionally, heat can be applied to the film and the tobacco mat to dry the film while the tobacco mat is wound toward and onto the second bobbin; however, preferably, the distance between the first and second bobbins is a distance effective to allow drying of the film between the first and second bobbins without the use of added heat. For example, a distance effective to allow drying of a film made of carrageenan on a tobacco web about 16 inches wide, is about 33 feet between the first and second bobbin rolls.

While the invention has been described in detail with reference to specific embodiments thereof, it will be apparent to those skilled in the art that various changes and modifications may be made, and equivalents thereof employed, without departing from the scope of the claim.

The invention claimed is:

1. A method of making a cigarette in the form of an electrically heated smoking system comprising a tobacco rod, comprising forming a tobacco base web; applying to said tobacco base web a slurry comprising ground tobacco, temperature sensitive powder and additive material; and incorporating said resulting tobacco web into the tobacco rod wherein said additive material is releasably disposed and is capable of undergoing controlled release from the temperature sensitive powder when subjected to heat.

2. The method according to claim 1, wherein said temperature sensitive powder comprises multi-stage dried powder made by mixing liquid or viscous additive material with an emulsifier to form a first mixture; mixing the first mixture with a spray dryable product to form a second mixture; forming droplets of the second mixture; heating the droplets to a first temperature to dry the droplets; and heating the droplets to a second temperature to further dry the droplets and form the multi-stage dried powder, wherein the first temperature is different from the second temperature.

3. The method according to claim 1, wherein said additive material comprises flavorant.

4. The method according to claim 1, wherein said temperature sensitive powder comprises sorbitol, maltodextrin and/or starch.

5. The method according to claim 1, further comprising adding glycerin, pectin and/or tobacco dust to said slurry.

6. The method according to claim 1, wherein said slurry is spread onto said tobacco base web to form a relatively uniform thickness.

7. The method according to claim 1, comprising:

cutting said tobacco web or tobacco base web into a strip of predetermined width; and incorporating said strip into said tobacco rod.

8. The method according to claim 1, further comprising forming a film on said tobacco base web or tobacco web.

9. The method according to claim 8, comprising spraying said film in liquid form onto said tobacco base web or tobacco web before incorporating into said tobacco rod; and drying said film on said tobacco base web bearing said film before incorporating into said tobacco rod.

10. The method according to claim 1, wherein said ground tobacco of said slurry comprises reconstituted tobacco.

11. The method according to claim 1, wherein said additive material is menthol.

* * * * *